United States Patent [19]

Bader

[11] Patent Number: 4,552,265

[45] Date of Patent: Nov. 12, 1985

[54] CAN CLIP AND MULTIPLE CONTAINER PACKAGE

[75] Inventor: James S. Bader, Lakewood, Colo.

[73] Assignee: Adolph Coors Company, Golden, Colo.

[21] Appl. No.: 524,129

[22] Filed: Aug. 17, 1983

[51] Int. Cl.[4] ..... B65D 71/00

[52] U.S. Cl. ..... 206/159; 206/158; 206/161; 294/87.2

[58] Field of Search ..... 206/139–166, 206/199, 200, 427, 821; 220/234; 294/87.2

[56] References Cited

U.S. PATENT DOCUMENTS

| | | | |
|---|---|---|---|
| 911,884 | 2/1909 | Kyle | 229/37 R |
| 2,810,171 | 10/1957 | Brooks et al. | 206/159 |
| 2,815,855 | 12/1957 | Fisher | 206/161 |
| 3,002,612 | 10/1961 | Poupitch | 206/161 |
| 3,126,599 | 3/1964 | Holland | 206/159 |
| 3,321,076 | 5/1967 | Poupitch | 206/159 |
| 3,331,500 | 7/1967 | Poupitch | 206/164 |
| 3,357,551 | 12/1967 | DeShazor | 206/159 |
| 3,410,398 | 11/1968 | Arneson | 206/159 |
| 4,216,859 | 8/1980 | Bader et al. | 206/159 |

*Primary Examiner*—George E. Lowrance
*Assistant Examiner*—Jimmy G. Foster
*Attorney, Agent, or Firm*—Klaas & Law

[57] ABSTRACT

A clip for forming a multiple container package which is capable of securely holding cans to form a multiple can package and allowing ease of disengagement and relative bending of adjacent cans in directions parallel to the multiple container package. A cover is also disclosed which engages the clip which can comprise a coupon. The clip is designed to engage cans having a wide range of counter-sink depths by providing an ear having a guiding portion with sufficient flexibility to conform to the top portion of the can. A hook portion of the clip is designed to securely engage the chime portion of the can while uniform support is provided by a concentric support wall, to maintain engagement of the can in a secure manner with increased holding ability. A rib structure extends into the ear portion to provide additional support. Flange means limit movement of discrete body portions of the clip to allow ease in disengagement in response to radial diagonal movement of cans during disengagement.

8 Claims, 23 Drawing Figures

CAN CLIP AND MULTIPLE CONTAINER PACKAGE

BACKGROUND OF THE INVENTION

The present invention pertains generally to clip devices for holding cans to form a multiple container package and more particularly to molded clips which engage chime portions of cans.

A wide variety of can carriers have been used in the prior art to both protect and provide a means for forming a multiple container package which can be easily carried by a consumer. Considerations in providing a multiple container package for mass use include low cost of materials employed, ease of assembly, use of a package with sufficient strength to maintain integrity throughout shipping and handling, aesthetic appearance and the ability to provide advertising and promotional material relating to the product.

Commonly used can carriers include plastic band carriers, such as disclosed in U.S. Pat. Nos. 2,874,835 and 2,936,070 by Poupitch. These plastic band carriers are formed from a sheet of plastic material with a plurality of can receiving apertures formed therein that engage each can around its perimeter. Plastic band carriers provide inexpensive manner of forming a multiple container package because of the low cost of fabrication. However, plastic band carriers are not normally reuseable and generally do not provide a means for attaching a cover device to protect the can tops from contaminates.

Another means of forming a multiple container package comprises the use of sheet carriers which are similar to band carriers in that they engage the entire circumference of the top portion of the can or bottle with a plastic sheet material. Examples of sheet carriers include U.S. Pat. No. 3,612,266 issued to Graser on Oct. 12, 1971, U.S. Pat. No. 3,653,504 issued to Saumsiegle on Apr. 4, 1972, Canadian Pat. No. 714,401 issued to Illinois Tool Works, Inc. on July 27, 1965, U.S. Pat. No. 3,314,713 issued to Noel on Apr. 18, 1967, U.S. Pat. No. 4,316,538 issued to Manizza on Feb. 3, 1982 and U.S. Pat. No. 3,331,500 issued to Poupitch on July 17, 1959. An advantage of the sheet type carriers is the ability of this type of carrier to easily provide protection to the can surfaces from dirt and other contaminates during transportion and handling. Since the users mouth is placed directly on the can surface, and the can tab is disposed in the can fluid during opening, it is highly desirable to provide a multiple container device having a cover for protecting the tops of the cans. However, sheet carriers require a large amount of compositional material which greatly increases the cost of forming a multiple container package. Additionally, despite the large amount of compositional material and the ability of sheet carriers to protect the top surfaces of the cans from contamination, sheet carriers frequently fail to provide adequate retention of cans in the multiple container package.

Clip carriers which engage a chime portion of a can have been used to form multiple container packages. Examples of clip carriers include the U.S. patents issued to Poupitch including U.S. Pat. No. 3,321,076 issued on May 23, 1967, U.S. Pat. No. 3,727,752 issued July 7, 1970, U.S. Pat. No. 2,894,662 issued July 14, 1959, U.S. Pat. No. 2,923,405 issued Feb. 2, 1960, U.S. Pat. No. 2,923,406 issued Feb. 2, 1960, U.S. Pat. No. 3,002,612 issued Oct. 3, 1961, and U.S. Pat. No. 3,038,599 issued June 12, 1962, all of which are specifically incorporated herein by reference and form a part of this disclosure for all that they disclose. Other U.S. patents pertaining to clip carriers include U.S. Pat. No. 2,806,273 issued to Ruth on Sept. 17, 1957, U.S. Pat. No. 2,810,171 issued to Brooks et al. on Oct. 22, 1957, U.S. Pat. No. 2,815,855 issued to Fisher on Dec. 10, 1957, U.S. Pat. No. 2,837,803 issued to Wootton on June 10, 1958, U.S. Pat. No. 2,863,556 issued to Bedford on Dec. 9, 1958, U.S. Pat. No. 2,876,896 issued to Ziehmer on Mar. 10, 1959, U.S. Pat. No. 2,876,897 issued to Taylor on Mar. 10, 1959, U.S. Pat. No. 2,898,654 issued to Becker on Aug. 11, 1959, U.S. Pat. No. 2,909,820 issued to Ruth on Oct. 27, 1959, U.S. Pat. No. 3,022,888 issued to Brunsing on Feb. 27, 1962, U.S. Pat. No. 3,126,599 issued to Holland on Mar. 31, 1964, U.S. Pat. No. 3,134,485 issued to Bonkowski et al. on May 26, 1964, U.S. Pat. No. 3,143,210 issued to Heydon on Aug. 4, 1964, U.S. Pat. No. 3,184,260 issued to Horbath on May 18, 1965, U.S. Pat. No. 3,198,326 issued to Brunsing on Aug. 3, 1965, U.S. Pat. No. 3,202,447 issued to Whaley et al. on Aug. 24, 1965, U.S. Pat. No. 3,206,019 issued to Curry et al. on Sept. 14, 1965, U.S. Pat. No. 3,357,551 issued to De Shazor on Dec. 12, 1967, U.S. Pat. No. 3,370,700 issued to De Shazor on Feb. 27, 1968, U.S. Pat. No. 3,434,592 issued to Moore et al. on Mar. 25, 1969, U.S. Pat. No. 3,233,730 issued to Winters et al. on Feb. 8, 1966, and U.S. Pat. No. 4,216,859 issued to James S. Bader et al. on Aug. 12, 1980, all of which are specifically incorporated herein by reference and form a part of this disclosure for all that they disclose. The clip carriers disclosed in the above referenced patents comprise both metal and plastic clips. Metal clips have been found to be unsuitable because of the cost of production and materials and damage caused by the metal clips to the cans. Plastic clips have generally been unsuitable because of the inability of the clips to adequately retain or hold the cans in a multiple container package. In other words, conventional plastic clips have been unable to prevent accidental disengagement of cans during normal handling. An advantage of the molded clip is the cost and quantity of material required in the clips to form a standard sized multiple container package, is roughly equivalent to the amount of plastic material used in typical plastic band carriers. Another advantage of the molded clip is its ability to be reused in the multiple container package.

The can clip and package disclosed in U.S. Pat. No. 4,216,859 issued to Bader et al. on Aug. 12, 1980 overcomes many of the disadvantages and limitations of conventional plastic clips by providing a clip having a hinge area to allow movement of cans in a multiple container package in directions parallel to the multiple container package without exerting force on the chime engaging means. This results in a substantial reduction in torque on the chime engaging means of the clip as a result of forces produced during normal handling of the multiple container package. Consequently, the can clip disclosed in the above referenced Bader et al. patent is capable of in response to movement of cans in directions parallel to the multiple container package. This has greatly increased the holding ability of the can clip so as to substantially reduce accidental disengagement of cans as a result of forces produced during normal handling. The clip disclosed by Bader et al. also substantially reduces the amount of compositional material to even less than that required in conventional band carriers by utilizing hooks and tabs which are offset along the chime arc. In other words, a large contact area is provided without the necessity for utilizing a tab portion opposing the hook portion, while still maintaining the holding ability of the clip.

Although the Bader et al. clip is capable of holding cans in response to movement of the cans in directions parallel to the multiple container package, it has been found that torque produced in response to side diagonal movement of the cans occasionally causes accidental disengagement. For example, forces produced from acceleration in response to rotational movement of the multiple container package along a vertical axis parallel to the cans produces torque in a direction along the hook which can occasionally cause progressive disengagement of the hook along the chime portion of the can.

Additionally, since countersink depths vary greatly in cans produced by different manufacturers, it would be desirable to have a universal clip which is capable of attachment to a wide variety of cans having a wide range of countersink depths. Prior art clips have been unable to adapt to the wide range of countersink depths of various cans currently being produced because of the inability of ear portions of the clip to conform to different countersink depths.

SUMMARY OF THE INVENTION

The present invention overcomes the disadvantages and limitations of the prior art by providing a clip having a hook with a hook point which is disposed directly in the interface between the chime portion and can body portion of the can. The hook point becomes securely seated in the interface so as to become securely attached to the can. Additionally, the hook has a hook radius which is contiguous with the radial shape of the cover hook radius portion of the chime portion of the can so that the hook means conforms to the chime portion to securely hold the can. The hook therefore securely engages and holds the can by the chime portion. Also, a support wall is provided having an outer wall which is concentric with the hook to uniformly support the hook along the entire predetermined arcuate length which the hook engages the chime portion of the can. Uniform support and secure engagement of the can by virtue of the shape of the hook substantially increases the holding ability of the clip to both radial diagonal movement and side diagonal movement.

The hook of the present invention also employs hinge means which substantially reduces forces produced on the hook in response to movement on the can in directions parallel to the multiple container package. Because of the substantially increased holding ability of the clip resulting from the uniform support provided by the support wall and the engagement of the hook in the chime portion, flange means are provided in the present invention to maintain the position of the support wall means relative to the clip during disengagement of the can by movement of the can in a radial diagonal direction so as to allow the holding portion of the ear means to move relative to the hook means to release the cans from the clip. Movement is limited by an amount sufficient to maintain engagement of the hook means and chime portions in response to movement encountered in a radial diagonal direction as a result of the weight of the can and forces produced in response to its momentum during normal handling movements.

Also, a rib support structure is provided between the concentric support wall and the ear means to limit movement, i.e., arcing of the ear shelf means during disengagement of the can, to allow for easier disengagement of the can by movement of the can in a radial diagonal direction. The ear means of the present invention includes a holding portion which has sufficient strength to maintain engagement of the hook in the chime means during normal handling and a guiding portion which guides the clip onto the can and has sufficient flexibility to conform to a wide range of countersink depths so that the clip can be universally applied to many different types of cans.

Consequently, the present invention provides a clip carrier which uses a small amount of compositional material, which can be reused, which securely holds the cans in a multiple container package and which allows easy removal of the cans from the multiple container package.

OBJECTS OF THE INVENTION

It is therefore an object of the invention to provide an improved clip carrier.

Another object of the present invention is to provide a clip for coupling cans to form a multiple container package.

Another object of the present invention is to provide a clip which uses a small amount of compositional material and which is capable of securely holding a plurality of cans in a multiple container package.

Another object of the present invention is to provide a clip which allows easy disengagement of a can from a multiple container package.

Another object of the present invention is to provide a clip having a plurality of discrete body portions wherein each of the discrete body portions is capable of holding a can to form a multiple container package.

Another object of the present invention is to provide a clip for holding a can to form a multiple container package.

Another object of the present invention is to provide a clip for holding a plurality of cans in a group by engaging a chime portion on each of the plurality of cans.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
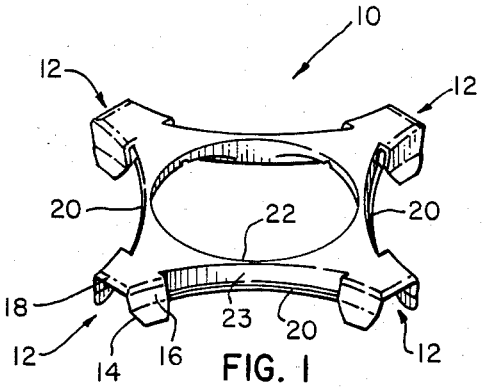
FIG. 1 is a schematic top isometric view of the clip of the present invention.

FIG. 1 comprises a top isometric view of the clip 10 of the present invention having four discrete body portions. Each of the discrete body portions has hook means 20 for engaging a chime portion of the can. Coupled to each of the hook means 20 is a support wall means 22 having an outer wall surface 23 which is essentially concentric with the arc of the hook means 20 to provide uniform support for hook means 20. The discrete body portions also include ear means 12 having guiding portion means 14 and holding portion means 16. Holding portion means 16 are supported by ear shelf means 18.

Figure 2:
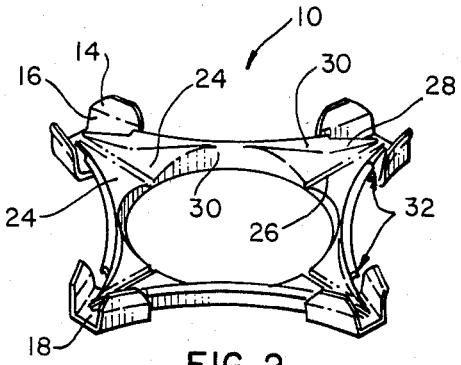
FIG. 2 is a schematic bottom isometric view of the device of the present invention.

FIG. 2 is a schematic isometric bottom view of clip 10. FIG. 2 illustrates flange means 24 which is coupled to support wall means 22 along inner wall surface 30. Hinge means 26 is coupled to flange means 24 and provides a predetermined line of weakness between discrete body portions of clip 10. As illustrated in FIG. 1, clip 10 has four discrete body portions with identical parts coupled together by hinge means 26. Rib support means 28 is coupled to support wall means 22 and extends beyond end portions 32 of support wall means 22 in an arcuate path, as illustrated in FIG. 2. Rib support means 28 is also coupled to ear shelf means 18 and limits movement of ear support means 18 during disengagement of the can.

Figure 3:
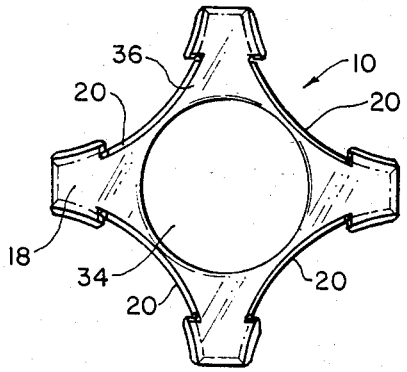
FIG. 3 is a schematic top plan view of the clip of the present invention.

FIG. 3 is a schematic top view of clip 10 illustrating the circular central opening 34 which is conveniently shaped for finger engagement. Circular central opening 34 is disposed over the interstitial opening between a group of cans forming the multiple container package so that a users finger can be inserted in circular central opening 34 without interference from the cans held by clip 10. FIG. 3 also illustrates clip shelf means 36 which comprises a substantially flat upper surface of clip 10. Clip shelf means 36, together with ear shelf 18 comprise the upper surface of the clip 10. Hook means 20 has a hook point which faces in an upward direction to engage the chime portion of a can.

Figure 4:
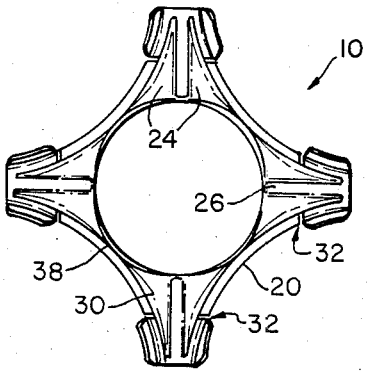
FIG. 4 is a schematic bottom plan view of the clip of the present invention.

FIG. 4 is a schematic bottom plan view of the clip 10. As shown in FIG. 4, flange means 24 has a substantially triangular shape and forms the surface of the circular central opening 34. Hook means 20 and support wall means 22 have a predetermined arcuate length with end portions 32 adjacent to ear means 12 and a middle portion 38 at the center of the arc. FIG. 4 also illustrates inner wall surface 30 which has a larger radius of curvature than outer wall surface 23 so that middle portion 38 of support wall means 22 has a smaller cross-sectional thickness than end portions 32 of support wall means 22. This provides greater support at end portions 32 of hook means 20.

Figure 5:
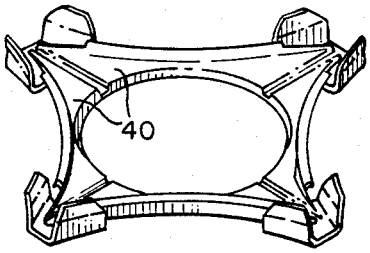
FIG. 5 is a bottom isometric view of an alternative embodiment of a clip of the present invention.

FIG. 5 is a schematic bottom isometric view of an alternative embodiment utilizing flange means 24 having a structure 40 with a uniform cross-sectional thickness. The uniform cross-sectional thickness of flange means 24 reduces the material utilized in the clip illustrated in FIG. 5. Additional support can be provided, if necessary, by increasing the cross-sectional thickness of the support wall means 22 of the clip illustrated in FIG. 5 to provide support to the hook means 20 of the clip.

Figure 6:
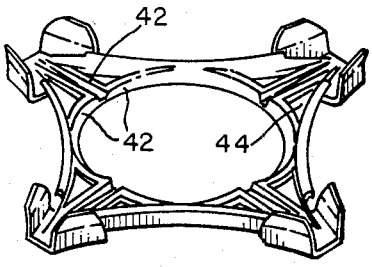
FIG. 6 is a bottom isometric view of another alternative embodiment of a clip of the present invention.

FIG. 6 comprises an alternative embodiment having flange means 24 which are formed from a rib structure 42. Rib structure 42 allows removal of plastic material from central portion 44 of the flange means 24 to reduce the amount of compositional material in the clip. Rib structure 42 provides essentially the same structural support as the solid structure of flange means 24 in the embodiment illustrated in FIGS. 1–4 and FIG. 5, while using substantially less compositional material. Clip shelf means 36 is coupled to rib structure 42 on the top surface of the clip and also provides support for rib structure 42.

Figure 7:
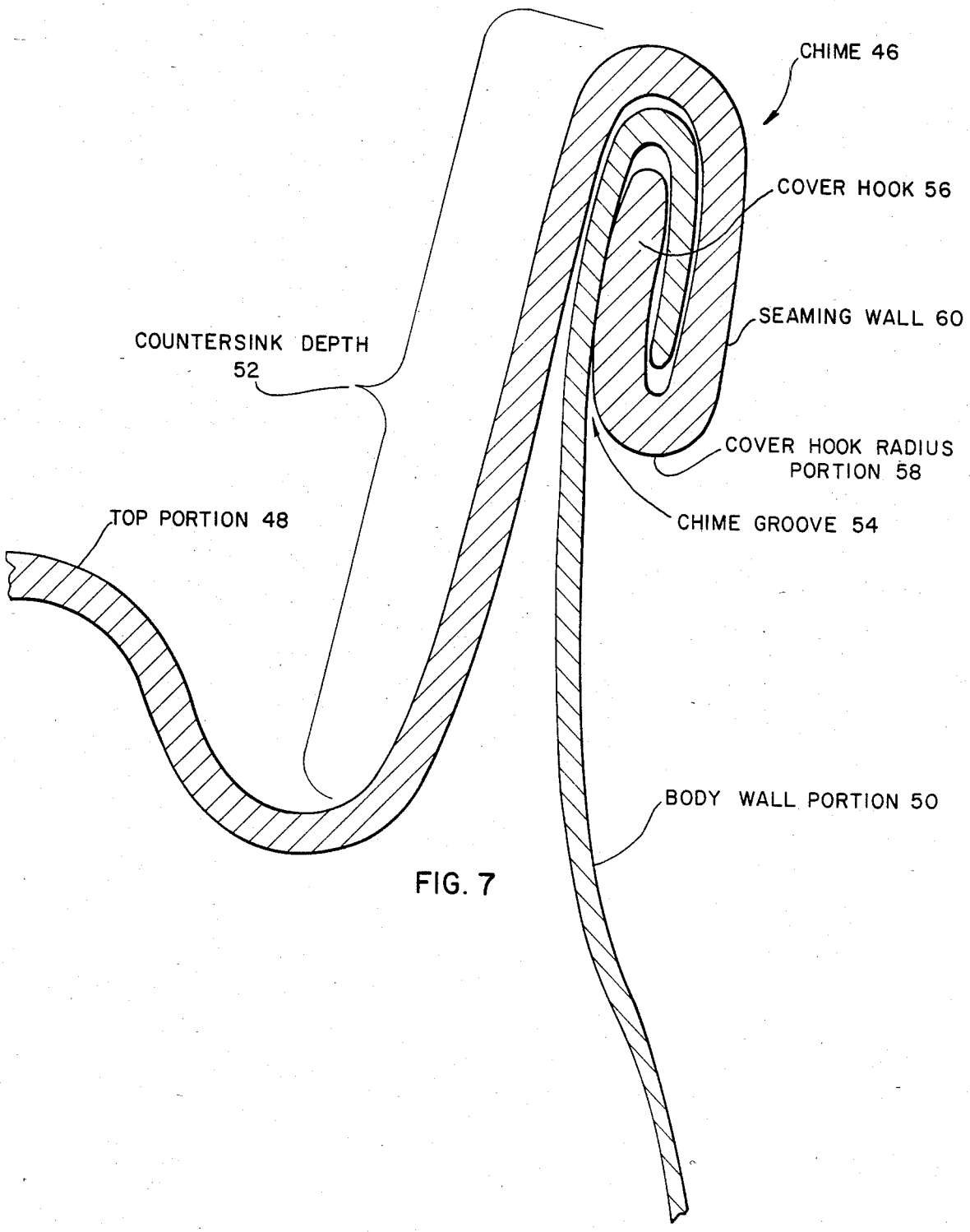
FIG. 7 is a schematic cross-sectional view of a typical chime portion of a can.

FIG. 7 is a schematic cross-sectional diagram of the chime portion 46 of a typical beverage can. The chime portion 46 is formed from a top portion 48 and a body wall portion 50 in a two piece can. Chime portions can also be formed from a body wall portion and a bottom portion in a three piece can.

For the purposes of the present invention, attachment by a clip formed on the chime portion 46 between the top portion 48 and body wall portion 50, will be considered. The chime portion 46 provides an air tight seal capable of withstanding pneumatic pressures generated within the can. Top portion 48 is formed in a configuration to produce a countersink having a predetermined countersink depth 52. A chime groove 54 is formed at the interface of the chime portion 46 and can body portion 50 of the can so that a seam is formed between cover hook 56 and body wall portion 50. The bottom of chime 46 is referred to as the cover hook radius portion 58 which has a predetermined curvature. The curvature of cover hook radius portion 58 is substantially uniform for most chimes formed on beverage containers. The cover hook radius portion 58 is coupled to seaming wall 60 which forms the outer most surface of the chime 46.

Figure 8:
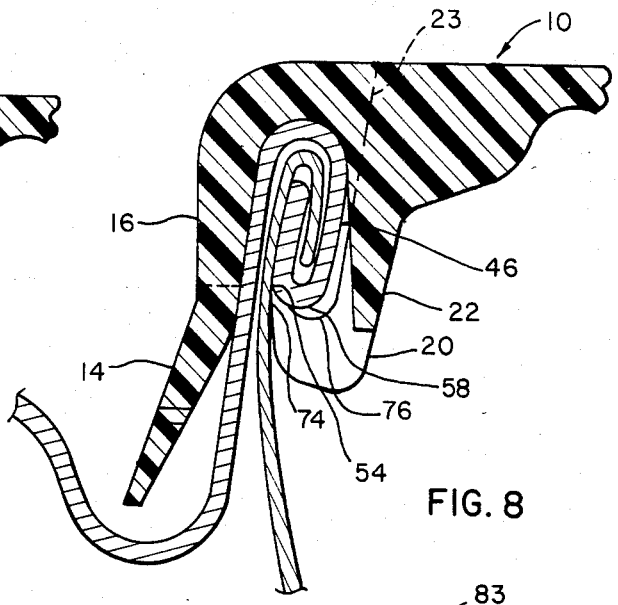
FIG. 8 is a schematic cross-sectional view of the clip engaging a chime portion of the can.

FIG. 8 discloses the manner in which clip 10 engages chime portion 46 of the can. Chime portion 46 is disposed between outer wall surface 23 of support wall means 22 and the inner wall surface of holding portion means 16. Holding portion means 16 has sufficient spaces provided between holding portion means 16 and outer wall surface 23 to engage a wide variety of chime configurations. Upper portions of the countersink rest directly along the inner wall surface of holding portion means 16 for support. Hook point means 74 is disposed directly in chime groove 54 to securely engage chime portion 46. Hook point means 74 is disposed in the seam between a cover hook 56 and body wall portion 50. The shape of hook radius means 76 substantially matches the shape of cover hook radius portion 58 to provide uniform support and to securely engage chime portion 46. Guiding portion means 14 sits freely within the countersink of top portion 48 of the can. Sufficient flexibility is provided in guiding portion 14 to allow conformity of the guiding portion 14 to a wide variety of countersink profiles.

Figure 9:
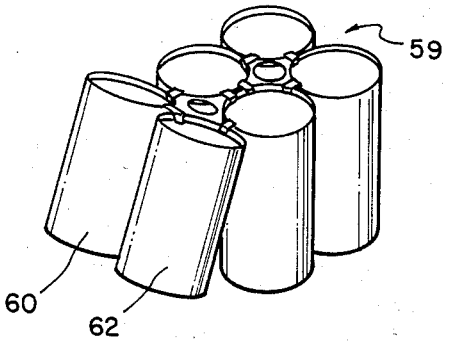
FIGS. 9 and 10 are schematic isometric views of multiple container packages illustrating movement of adjacent cans in directions parallel to the multiple container package.
Figure 10:
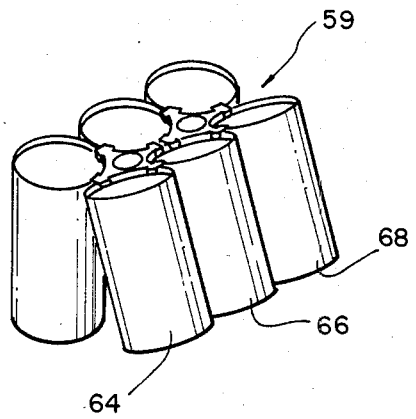

FIGS. 9–12 illustrate the various movement of cans in a multiple container package. FIGS. 9 and 10 illustrate simultaneous movement of adjacent cans in directions which are substantially parallel to the multiple container package. FIG. 9 illustrates simultaneous parallel movement of cans 60 and 62 from the multiple container package. FIG. 10 illustrates simultaneous movement of cans 64, 66, 68 in a direction parallel to the multiple container package.

Figure 11:
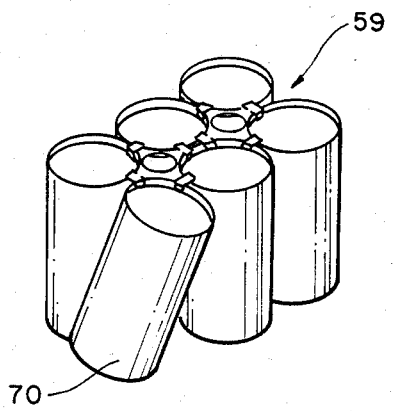
FIG. 11 is a schematic isometric view of a multiple container package illustrating side diagonal movement of one of the cans of the multiple container package.
Figure 12:
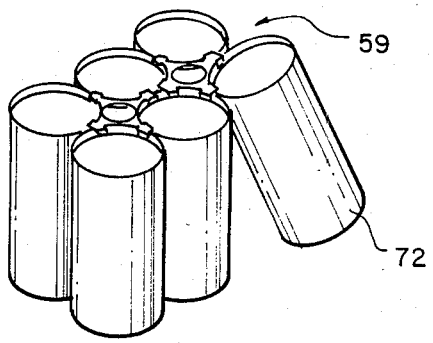
FIG. 12 is a schematic isometric view of a multiple container package illustrating radial diagonal movement of one of the cans of the multiple container package.

FIGS. 11 and 12 illustrate movement of cans in a direction substantially diagonal to the multiple container package. FIG. 11 illustrates a substantially side diagonal movement of cans 70 relative to the multiple container package. FIG. 12 illustrates a substantially radial diagonal movement of can 72 relative to the multiple container package.

Figure 13:
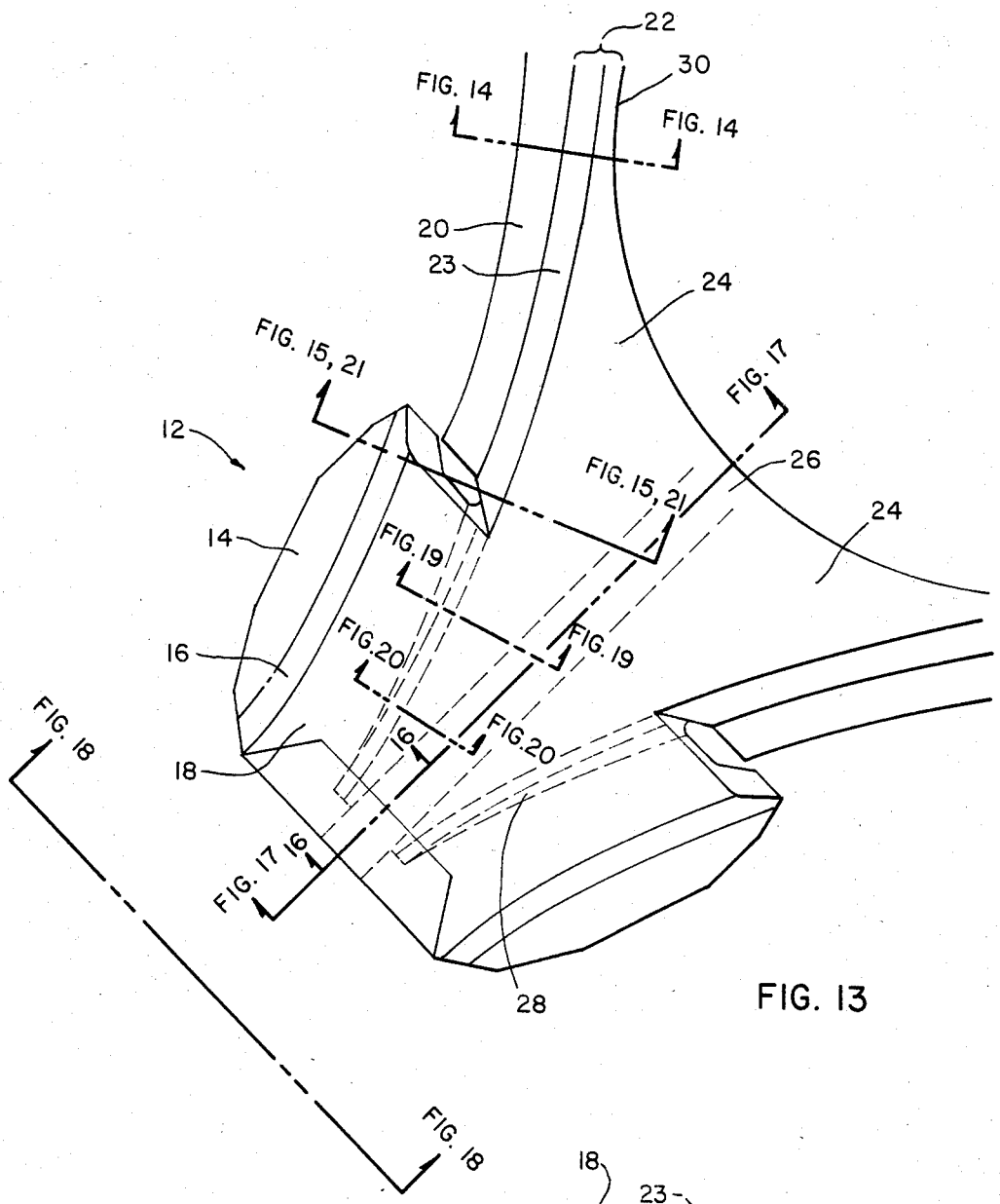
FIG. 13 is a schematic top view illustrating a segment of the clip of the present invention.

FIGS. 13–21 comprise detailed drawings of clip 10, illustrating various portions of clip 10 in detail. FIG. 13 comprises a detailed plan view of clip 10 illustrating the cross-sectional views of FIGS. 14–20. FIG. 13 also illustrates various portions of clip 10 including ear means 12 having guiding portion means 14 holding portion means 16 and ear shelf means 18 which is coupled to holding portion means 16. Hook means 20 is also illustrated in FIG. 13 which is coupled to support wall means 22 having an outer wall surface 23 which is concentric with hook means 20. Support wall means 22 has an inner wall surface 30 which can be substantially concentric with outer wall surface 23, or a radius of curvature slightly larger than outer wall surface 23 to provide greater support to end portions which are coupled to flange means 24. Flange means 24 are coupled to support wall means 22 and joined by hinge means 26 which function to couple adjacent discrete body portions along a predetermined line of weakness. Rib support means 28 comprises an extention of structural wall 22 and are coupled to ear shelf means 18.

Figure 14:
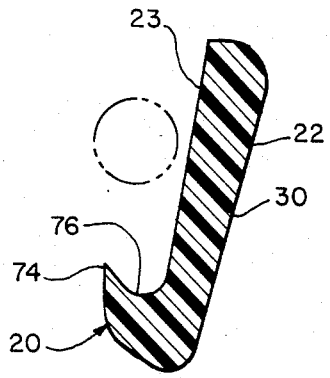
FIG. 14 is a cross-sectional view of FIG. 13 illustrating the hook means and support wall means.

FIG. 14 comprises a cross-sectional view of the support wall means 22 and hook 20. Support wall means has an outer wall surface 23 which is concentric with hook 20 and an inner wall surface 30 which produces a support wall which may have a constant or varying cross-sectional thickness, as disclosed above. Hook means 20 includes hook point means 74 which engages the chime portion of 46 of the can in the chime groove 54. The curvature of hook means 20 is defined by hook radius means 76. The shape of hook radius means 76 is substantially contiguous with the shape of cover hook radius portion 58 of chime 46. In this manner, hook means 20 is capable of supporting chime 46 in a uniform manner. Outer wall surface 23 is substantially contiguous with seaming wall 60 to provide additional support.

Figure 15:
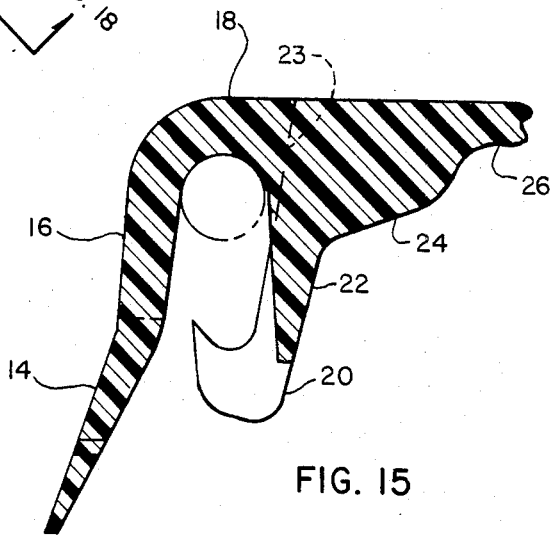
FIG. 15 is a cross-sectional view of FIG. 13 illustrating the hook means and ear means.

FIG. 15 is a cross-sectional view of clip 10, as illustrated in FIG. 13. As shown in FIG. 15, hinge means 26 is coupled to flange means 24, which is in turn coupled to support wall means 22. Flange means 24 has a varying cross-sectional thickness to provide increased support to support wall means 22 at end portions 32 of hook means 20. FIG. 15 also illustrates the manner in which outer wall surface 23 is aligned with other portions of the clip. Holding portion means 16 is coupled to ear shelf means 18 and functions to maintain engagement of chime 46 with hook means 20. Guiding portion means 14 is coupled to holding portion means 16 and functions to guide the clip 10 into engagement with the can. Guiding portion means 14 is flared to have a decreasing cross-sectional thickness so as to provide sufficient flexibility to allow guiding portion means 14 to conform to a wide range of countersink depths 52.

Figure 17:
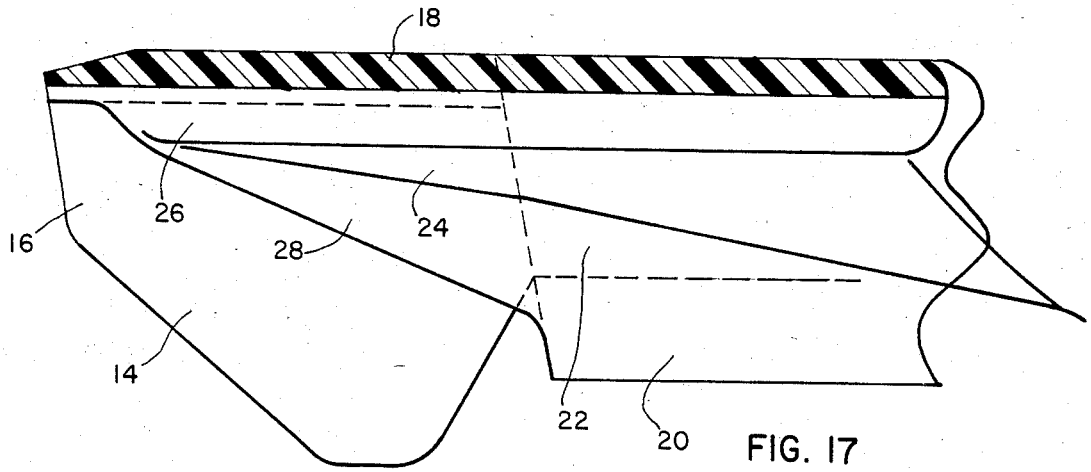
FIG. 17 is a cross-sectional view of FIG. 13 illustrating the ear means, flange means and support wall means.
Figure 16:
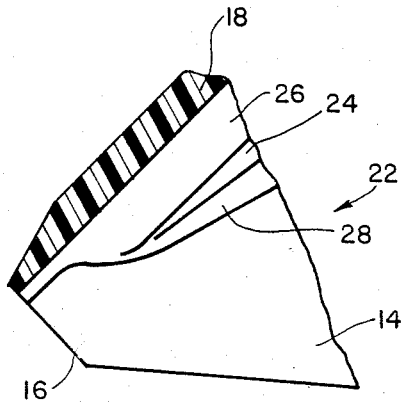
FIG. 16 is a cross-sectional view of FIG. 13 illustrating the ear means.

FIGS. 16 and 17 comprise cross-sectional views of ear means 12. FIG. 16 illustrates guiding portion means 14 and holding portion means 16 of ear means 12 which are coupled to rib support structure 28. Flange 24 is coupled to rib support structure 28 and provides support to rib support structure 28 for a substantial portion of the length of ear means 22. The curved inclined portion of hinge means 26 is also illustrated in FIG. 16, which forms a line of weakness along the decreased cross-sectional thickness of ear shelf means 18, as illustrated in FIG. 16.

FIG. 17 illustrates a cross-sectional view of ear means 12 including portions of support wall means 22 and hook means 20. As is shown in FIG. 17, rib support means 28 is coupled to the end portions of hook means 20 and support wall means 22. The cross-sectional thickness of ear shelf means 18 along hinge means 26, as illustrated in FIG. 17, provides sufficient flexibility to allow the discrete body portions of the clip to flex along the lines of weakness of hinge means 26.

Figure 18:
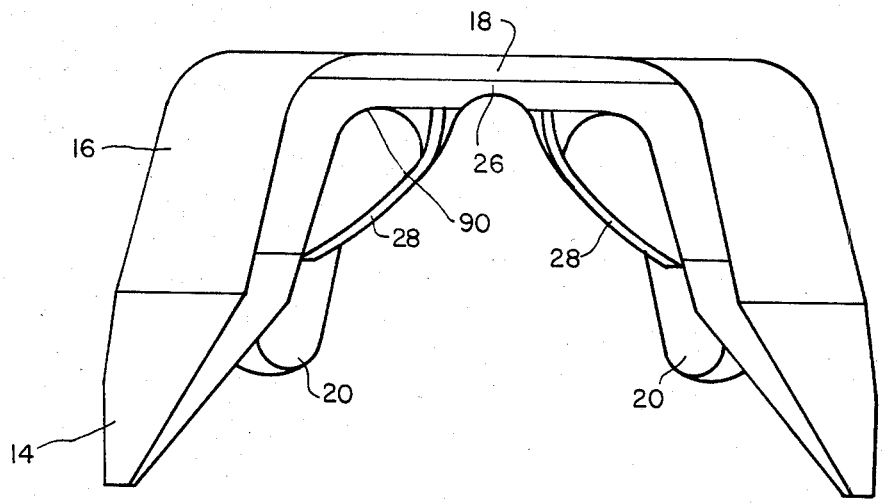
FIG. 18 is an end view of the segment of the clip illustrated in FIG. 13.

FIG. 18 is an end view of ear means 12. Guiding portion means 14 and holding portion means 16 are curved to fit the arcuate path of the chime 46 of the can. Rib support means 28 is curved along the same arcuate path formed in ear groove 90. FIG. 18 also illustrates the manner in which hinge means 26 decreases the cross-sectional thickness of ear shelf means 18 to provide flexibility between discrete body portions.

Figure 19:
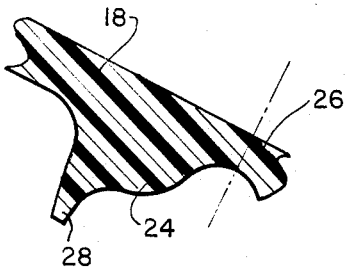
FIG. 19 is a cross-sectional view of FIG. 13 illustrating the flange means and rib support means.
Figure 20:
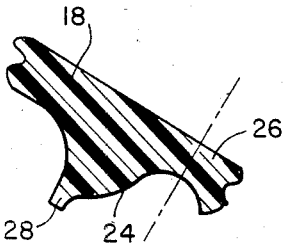
FIG. 20 is a cross-sectional view of FIG. 13 illustrating the flange means and rib support means at an extended position.

FIGS. 19 and 20 comprise cross-sectional views of portions of ear means 12. FIGS. 19 and 20 illustrate the manner in which the width of flange means 24 gradually decreases in a direction toward the end of ear means 12. FIGS. 19 and 20 also illustrate the reduced cross-sectional thickness of hinge means 26 in comparison to ear shelf means 18.

Figure 21:
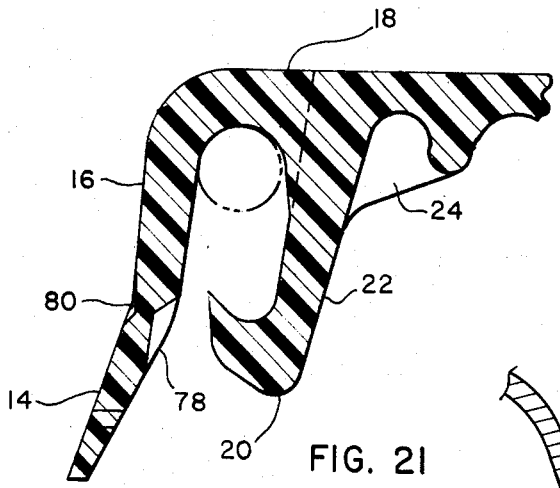
FIG. 21 is a cross-sectional view of FIG. 13 illustrating ear means which employs a notch for greater flexibility.

FIG. 21 is a cross-sectional view illustrating an alternative embodiment of ear means 12. As shown in FIG. 21, hook means 20, support wall means 22, flange means 24 and ear shelf means 18 are identical to the corresponding parts illustrated in FIG. 15. Notches 78 and 80 are provided between guiding portion means 14 and holding portion means 16 in the embodiment of FIG. 21 to provide flexibility to guiding portion means 14 such that ear means 12 is capable of conforming to a wide range of countersink depths. Notches 78 and 80 reduce the cross-sectional thickness at the interface of guiding portion 14 and holding portion 16 to allow guiding portion 14 to flex relative to holding portion 16 to allow the guiding portion 14 to conform to the countersink of the can during engagement. Notches 78 and 80 are located below the adjacent portion of hook means 20 so that the holding ability of holding portion 16 is not reduced.

In operation, clip 10, as illustrated in FIGS. 1–6 and 13–21, has four discrete body portions, each of which is capable of holding a can to form a multiple container package. Hook means 20 engages the chime portion of the can along a predetermined arcuate length of the chime portion. The hook means has a hook point 74 which is disposed in the chime groove 54 of the can at the interface between the body wall portion 50 and cover hook portion 56 to securely hold the hook means 20 in interlocking engagement with the chime portion 46. The hook point means 74 substantially fills the chime groove 54 and is disposed in the seam of the chime groove 54 to increase the holding ability of the hook means 20. Hook means 20 has a hook radius 76 with a curved shape which is contiguous with the curved shape of the cover hook radius portion 58 of chime portion 46. This further increases the holding ability of hook means 20 since the clip more securely engages the chime portion 46 of the can. Support wall means 22 is coupled to the hook means 20 and has a shape which is concentric with the arcuate shape of the hook means 20 so as to provide uniform support to the hook means along the entire arcuate length which the hook means 20 engages the chime portion 46 of the can. The outer wall surface 23 of support wall means 22 comprises a substantially vertical support structure which is concentric with the arcuate path of hook means 20 so as to provide support to end portions 32 of hook means 20 which is essentially equal to the support provided to middle portion 38 of hook means 20. The uniform support provided by support wall 22 prevents progressive disengagement of the clip, especially in response to side diagonal movement such as illustrated by the movement of can 70 in FIG. 11. Side diagonal movement of the cans in the multiple container package 59 produces increased torque on end portions 32 of hook means 20. Support is also provided to ear means 12 by rib support means 28 which follows the arcuate path of support wall means 22 and extends into ear means 12 to support ear shelf means 18 in response to side diagonal movement, such as illustrated in FIG. 11. As illustrated in FIG. 4, the support wall means 22 can, alternatively have an inner wall surface 30 with a larger radius of curvature, as illustrated in FIG. 4, to provide added support to end portions 32 of support wall means 22.

Flange means 24 also provides additional support to end portions 32 of support wall means 22, as well as ear shelf means 18. However, flange means 24 has a structure which is aligned with hinge means 26 so that flange means 24 is capable of substantially maintaining the position of support wall means 22 relative to the remaining portions of the clip in response to radial diagonal movement, such as illustrated by can 72 in FIG. 12. In other words, flange means 24 limits the movement of support wall means 22 and ear shelf means 18 relative to the clip by an amount sufficient to maintain engagement of the hook means 20 and the chime portion 46 of the can in response to forces produced by the cans on the clip 10 during normal handling, while simultaneously allowing holding portion means 16 and guiding portion means 14 of ear means 12 to bend outwardly in response to radial diagonal movement of the can, so as to allow disengagement of the hook means 20 from the chime portion 46 of the can. Without the support structure provided by flange means 24 and rib support means 28 to support wall means 22 and ear shelf means 18, movement of each of the discrete body portions of the clip 10 would not otherwise be substantially limited, so that disengagement of the can by radial diagonal movement would not otherwise result in relative movement between holding portion means 16 of ear means 12 and hook means 20, thereby preventing disengagement of the can from the clip 10 without substantial difficulty. In other words, radial diagonal movement of the can would otherwise cause simultaneous arcing of hook means 20, support wall means 22, ear shelf means 18, clip shelf means 36 and holding means 16, so that the relative positions of hook means 20 and holding portion means 18 would remain constant and thereby prevent disengagement of the chime portion 46 from hook means 20.

Consequently, the holding ability of clip 10 is greatly increased by the shape of hook means 20 as well as the uniform support provided by support wall means 22 and rib support means 28, so as to prevent accidental disengagement in response to normal handling movements, such as side diagonal movements, while allowing easy disengagement of the can from clip 10 in response to radial diagonal movement, by limiting movement of the support wall means 22 and ear shelf means 18 relative to other discrete body portions of the clip.

Accidental disengagement of cans during normal handling is also prevented by hinge means 26 which provides a line of weakness allowing simultaneous bending of adjacent discrete body portions of clip 10 joined by hinge means 26. In other words, the flexible web portion of hinge means 26 allows simultaneous movement of adjacent cans in directions substantially parallel to the multiple container package, such as illustrated in FIGS. 9 and 10. This discreases torque on the hook means 20 for movement of cans in directions parallel to the multiple container package 59.

Figure 22:
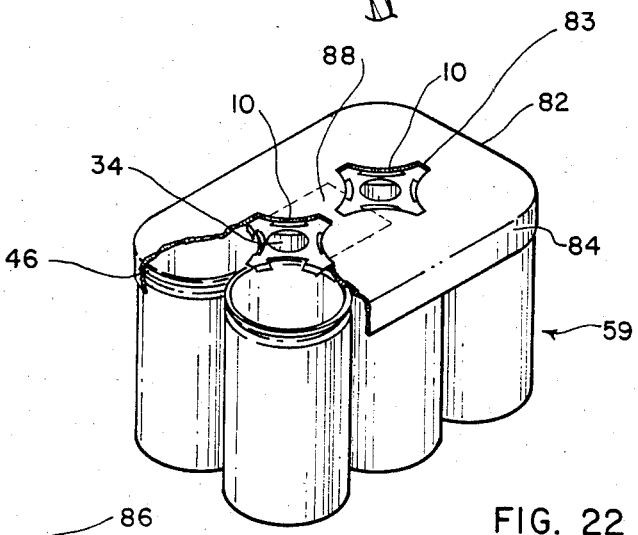
FIG. 22 is a schematic isometric view of a multiple container package employing a cover.
Figure 23:
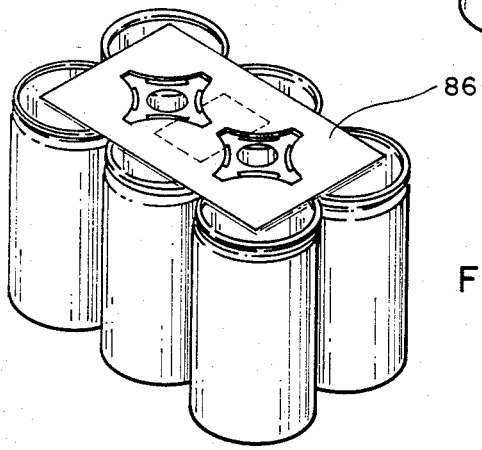
FIG. 23 is a schematic isometric view of a multiple container package employing a partial cover.

FIGS. 22 and 23 illustrate covers which can be used in conjunction with clip 10, as illustrated in FIGS. 1 through 6 and 13 through 21. Cover means 82, illustrated in FIG. 22, has a main body portion 83 and side panel portions 84 which maintain the relative position of cover means 82 with respect to the multiple container package 59. Cover means 82 has tabs formed in main body portion 83 which engage clip 10 to hold cover means 82 in engagement with clip 10, as more fully disclosed in U.S. patent application Ser. No. 292,811 filed Aug. 14, 1981 by James S. Bader entitled Cover For Multiple Unit Container Packages, which is specifically incorporated herein by reference and forms a part of this disclosure for all that it discloses. Tab portions formed in main body portion 83 are inserted through circular central opening 34. Cover means 82 covers chime portion 46 of the cans forming the multiple container package 59 and provide protection to the top surfaces of the cans from contaminates. Coupon means 88 can be formed from main body portion 83 and detached therefrom by cut and score lines, as illustrated in FIG. 22, or can comprise separate coupon means 88 attached to main body portion 83 for removal from cover means 82.

FIG. 23 illustrates an additional cover means 86 which covers only a portion of the tops of the cans in the multiple container package 59. Cover 86 is attached to clips 10 in the same manner as disclosed in the above-identified application. Cover 86 can, itself, comprise a coupon or have a portion thereof formed as a coupon for removal from cover 86, as illustrated in FIG. 23, or have a coupon attached thereto.

Consequently, the present invention provides a clip for forming a multiple container package which has increased holding ability and provides uniform support to prevent accidental disengagement of cans from the multiple container package, while allowing easy disengagement of individual cans from the multiple container package by radial diagonal movement. The clip provides sufficient torque stability as a result of the uniform support provided by a concentric support wall to prevent accidental disengagement in response to side diagonal movement, while simultaneously providing increased holding ability. Flange means are also provided which limit movement of discrete body portions during disengagement to allow the holding portion of the ear means to move relative to the hook means so that the container can be disengaged from the clip without substantial difficulty. Consequently, cans are held in the multiple container package with great stability to maintain engagement of the cans with the clip in the multiple container package in response to normal handling movements and allow disengagement from the clip with relative ease by radial diagonal movement.

The foregoing description of the invention has been presented for purposes of illustration and description. It is not intended to be exhaustive or to limit the invention to the precise form disclosed, and other modifications and variations may be possible in light of the above teachings. For example, although the clip of the present invention is normally formed by conventional injection molding techniques using thermo-plastic materials such as acrylonitrile-butadiene-styrene, polyesters such as polyethylene terephthalate, or polypropylene, polystyrene, or other suitable materials or methods of forming the clip can be used.

The embodiments were chosen and described in order to best explain the principles of the invention and its practical application to thereby enable those skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A clip having a plurality of discrete body portions, each of said discrete body portions capable of holding a can to form a multiple container package, said discrete body portions comprising:

hook means for engaging a chime portion of said can;

support wall means integral with and extending upwardly from said hook means said support wall means having a surface in contact with an adjacent surface of said can for uniformly supporting said hook means along a predetermined arc which is concentric with said hook means;

a plurality of spaced apart ear means having holding portion means extending downwardly and located for holding said can in engagement with said hook means;

said hook means and said support wall means extending for substantially the entire distance between said spaced apart ear means but spaced a short distance from each of said ear means;

shelf means integral with said ear means and extending inwardly from said ear means at the upper portion of said ear means;

flange means integral with said shelf means and the upper portion of said support wall means;

hinge means integral with said shelf means and said flange means for coupling said shelf means and said flange means of adjacent discrete body portions along predetermined lines of weakness;

said flange means maintaining the position of said support wall means relative to said plurality of discrete body portions during disengagement of said can from each of said spaced apart ear means by limiting movement of said support wall means relative to said plurality of discrete body portions to allow said ear means to move relative to said hook means during disengagement of said can to release said can from said discrete body portion.

2. The clip of claim 1 wherein said hook means comprises:

hook point means for engaging said can in a chime groove formed at the interface of said chime portion and a can body portion of said can such that said hook point means substantially fills said chime groove and is disposed in said interface of said can body portion and said chime portion;

hook radius means for supporting said can by said chime portion, said hook radius means having a radial shape which is contiguous with the radial shape of a cover hook radius portion of said chime portion.

3. The clip of claim 2 wherein said support wall means comprises:

an outer wall surface having a predetermined radius of curvature and aligned with said hook means such that said outer wall surface is essentially concentric with said hook means to provide uniform support to said hook means.

4. The clip of claim 3 wherein said ear means comprises:

holding portion means for maintaining said hook means in engagement with said chime means during normal handling;

guiding portion means for guiding said clip into engagement with said can, said guiding portion means having sufficient flexibility to conform to a wide range of countersink profiles and depths.

5. The clip of claim 4 further comprising:

notch means disposed between said holding portion means and said guiding portion means to provide a hinge point between said holding portion means and said guiding portion means to accomodate various countersink profiles.

6. The clip of claim 4 wherein said guiding portion means has a variable cross-sectional thickness to provide a flared structure with sufficient flexibility to conform to a wide range of countersink depths.

7. The clip of claim 1 wherein said clip further comprises:

rib support means coupled to said support wall means and extending beyond end portions of said support wall means along an arcuate path and coupled to said shelf means to limit movement of said shelf means to allow said ear means to bend relative to said shelf means during disengagement of said can.

8. The clip of claim 7 further comprising:

cover means coupled to said clip to cover said multiple container package.

* * * * *